United States Patent [19]

Silver

[11] 4,125,767

[45] Nov. 14, 1978

[54] PHOTOELECTRIC SWITCH AND DIMMER CONTROL

[76] Inventor: Harry Silver, 1844 Meadowbrook Rd., Abington, Pa. 19001

[21] Appl. No.: 814,062

[22] Filed: Jul. 8, 1977

[51] Int. Cl.[2] ..... H01U 39/19

[52] U.S. Cl. ..... 250/214 D; 250/214 AL

[58] Field of Search ..... 315/149, 150, 156, 157, 315/158, 159; 250/214 R, 214 D, 237 R, 208, 209, 206, 211 K, 214 AL

[56] References Cited

U.S. PATENT DOCUMENTS

| | | | |
|---|---|---|---|
| 2,917,663 | 12/1959 | Engelmann | 250/214 D |
| 3,500,455 | 3/1970 | Ross et al. | 315/149 |

*Primary Examiner*—David C. Nelms

*Attorney, Agent, or Firm*—Caesar, Rivise, Bernstein & Cohen, Ltd.

[57] ABSTRACT

A combination electric lamp dimmer with automatic photocontrol which is adapted for mounting within a conventional electrical junction box such as mounted within walls. The devices includes a rotary dimmer switch for adjusting the current magnitude provided to the lamp to establish the magnitude of light produced thereby. The position of the dimmer switch is controlled by a manually rotatable knob. The knob includes an opening in it to allow ambient light to pass therethrough. A photocell is mounted behind the knob. When a knob is rotated to a position wherein the opening is disposed over the photocell, the photocell is enabled to monitor the ambient light. When the ambient light intensity drops below a predetermined value, the photocell and switch means responsive thereto enable current to be provided through the dimmer to the lamp to illuminate it.

15 Claims, 6 Drawing Figures

PHOTOELECTRIC SWITCH AND DIMMER CONTROL

This invention relates generally to electrical switching and control devices and more particularly to devices for adjusting the intensity of lamps (such as incandescent lamps).

Various devices for adjusting the intensity of the light output of lamps have been disclosed in the patent literature and some are commercially available. The most common type of device is known generically as a dimmer switch and comprises a variable resistance element, e.g., potentiometer, or solid state controller, for adjusting the magnitude of current provided to the lamp to thereby adjust the light output thereof in response to the position of a rotary control knob. Examples of various types of lamp dimming devices are found in U.S. Pat. Nos. 3,401,265, 3,496,451, 3,746,923, and 3,935,505.

While prior art lamp dimmers are effective for adjusting the intensity of a lamp's light output, they are incapable of automatic operation, e.g., to illuminate the lamp in response to a sensed low ambient light level.

Various devices have also been proposed in the patent literature and some are commercially available for automatically controlling a lamp, such as turning it on and off or adjusting its intensity. Examples of such devices are shown in U.S. Pat. Nos. 3,500,455, 3,538,379, and 3,543,099. While such devices are suitable for the uses for which they are intended, the need presently exists for a combination lamp dimming device with automatic photoelectric control and which overcomes the disadvantages of prior illumination control devices.

Accordingly, it is a general object of this invention to provide a combination lamp intensity adjusting device with automatic photoelectric control which overcomes the disadvantages of the prior art.

It is a further object of this invention to provide a combination manually operable lamp intensity adjusting device with automatic photoelectric control for effecting the illumination of the lamp at a predetermined intensity in response to the sensing of a low ambient light level.

It is still a further object of this invention to provide a combination lamp intensity adjusting device with automatic photoelectric control and which is simple in construction and low in cost.

It is yet a further object of this invention to provide a combination lamp intensity adjusting device with automatic photoelectric control and which is small in size and suitable for utilization within conventional electrical junction boxes.

These and other objects of the instant invention are achieved by providing a lamp dimmer with automatic photoelectric control for establishing the light output of an electric lamp. The device comprises current adjusting means for adjusting the magnitude of electric current provided to the lamp to adjust its light output. The current adjusting means is coupled to a manually movable member. The position of the member establishes the magnitude of current conduction. The device also includes photoelectric control switching means which is enabled to sense the intensity of ambient light when the movable member is in a first predetermined position. The switching means, when enabled, is responsive to the intensity of the light reaching it to allow current to flow to the lamp to effect the illumination of the lamp when the intensity of the ambient light is below a predetermined value.

Other objects and many of the attendant advantages of this invention will be readily appreciated as the same becomes better understood by reference to the following detailed description when considered in connection with the accompanying drawing, wherein.

Figure 1:
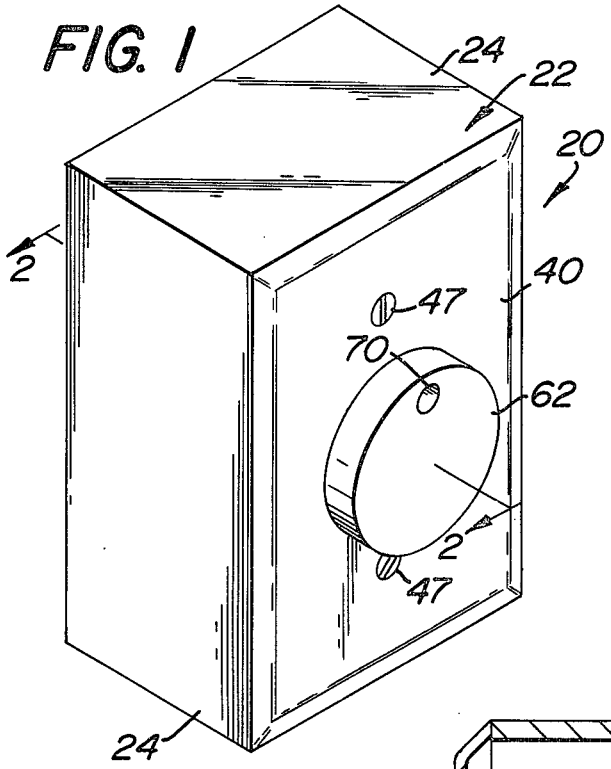
FIG. 1 is a perspective view of the lamp dimmer with automatic photoelectric control of the instant invention mounted within a conventional junction box.

Referring now to the various figures of the drawing wherein like reference characters refer to like parts, there is shown in FIG. 1 a lamp dimmer with automatic photoelectric control 20 mounted within a conventional junction box 22, such as typically found within the walls of residential, commercial and industrial buildings. The box 22 is of conventional construction and is merely exemplary of various types of junction boxes and the like in which the lamp dimmer and photoelectric control 20 of the instant invention can be conveniently mounted. To that end, box 22 comprises a plurality of side walls 24 and a bottom wall 26 having an opening 28 through which the electrical conductors connected the device 20 to the lamp to be controlled and the source of electricity extend for connection to the components of the device 20 located within the interior 29 of the box. Projecting up from the interior of the box are a pair of standards 30 having threaded holes 32 therein. The holes 32 are adapted to receive mounting screws 34 for mounting electrical components, such as switches, receptacles and the like therebetween in a conventional manner. In the instant invention the lamp dimmer and photoelectric control device 20 is mounted between said standards. To that end, the device 20 comprises a housing 36 in which the components forming the lamp dimmer and photoelectric control are housed and from which a pair of mounting brackets 38 project. Each mounting bracket 38 includes an opening through which a screw 34 extends for securement within the threaded hole 32 in the standard 30. In order to enclose the device 20 within the interior 29 of the junction box 22 a cover plate 40 is provided. The cover plate includes a pair of openings 41, each being aligned with threaded holes 45 in the brackets 38. A pair of screws 47 are screwed into the aligned holes 41 and 45 to mount the cover plate 40 over device 20 in the box 22. The plate 40 also includes an opening 43 through which a photocell (to be described later) of the device 20 extends.

The lamp dimmer with automatic photoelectric control device 20 basically comprises current adjusting means 42 for adjusting the magnitude of current provided by the device to a connected electric (e.g., incandescent or florescent) lamp 44 and photoelectric controlled switching means 46.

Figure 5:
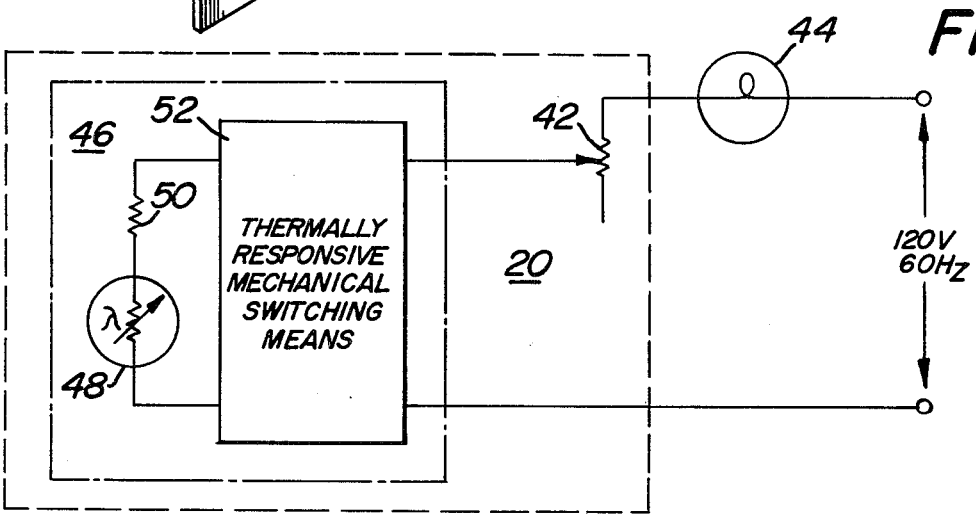
FIG. 5 is a schematic diagram of one embodiment of the device shown in FIG. 1.
Figure 6:
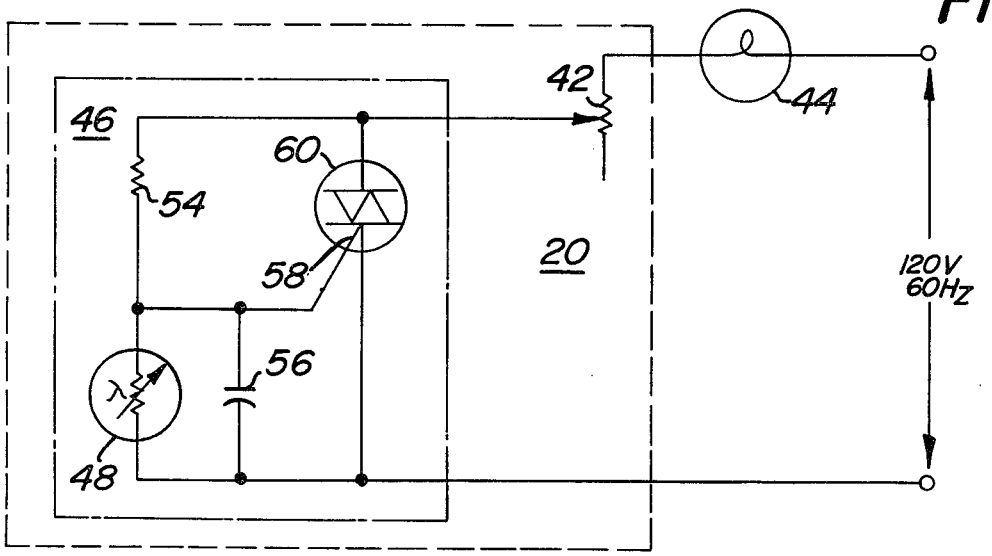
FIG. 6 is a schematic view of an alternative embodiment of the device shown in FIG. 1.

As can be seen in FIGS. 5 and 6, the current adjusting means 42 is connected in series with the photoelectric controlled switching means 46 to form device 20. The device 20 is arranged to be connected, via the conductors shown in FIG. 2, between a conventional power line (such as found in residential, commercial and industrial building structures) and the incandescent and florescent light source or lamp 44 being controlled.

The photoelectric controlled switching means 46 is operative, when enabled as will be described hereinafter, to respond to the intensity of light reaching it to allow said predetermined magnitude of current to flow through the current adjusting means 42 to the incandescent lamp 44 when the light intensity is below a threshhold level.

In accordance with a preferred aspect of the instant invention the current adjusting means 42 comprises a potentiometer or rheostat, of conventional construction and including a rotatable shaft 49. The rotational position of the shaft establishes the magnitude of current permitted to flow through the potentiometer.

In accordance with another aspect of the instant invention the photoelectrically controlled switching means 46 can take several forms. To that end, in FIG. 5 there is shown an electromechanical embodiment of the photoelectric controlled switching means, while FIG. 6 shows a solid state embodiment of said switching means.

The photoelectric controlled switching means 46 shown in FIG. 5 includes a conventional photocell 48 connected in series with a resistor 50. A thermally responsive mechanical switch 52 is connected to the series combination of the photocell 48 and resistor 50. The switch 52 is of conventional construction and includes a bimetallic element (not shown) disposed adjacent to the resistor 50. The bimetallic element is coupled to contacts (not shown) which, when closed, enable current to flow through the switch 46 and the potentiometer 42 from the 120V, 60HZ source.

Operation of the photoelectrically controlled switch 46 of FIG. 5 is as follows: when the light sensed by the photocell exceeds a predetermined value current flows through resistor 50, thereby causing said resistor to heat up. The heating of the resistor causes the bimetallic element of the thermally responsive switch 52 to deform thus causing the connected contacts to open, and thereby interrupting the flow of current from the 120V, 60HZ power source through the variable resistor 42 and the serially connected incandescent lamp 44. Conversely, when the magnitude of light sensed by photocell 48 drops below a predetermined threshhold value the current flowing through resistor 50 ceases. This action enables the resistor 50 to cool down, whereupon the contacts coupled to the bimetallic element close, thereby connecting the potentiometer 42 to the power source to illuminate the lamp at the intensity established by the setting of the potentiometer 42.

The photoelectrically controlled switching means 46 is of conventional type construction and is sold by various manufacturers. One such photoelectric control type is sold by Mulberry Metal Products, Inc., 2199 Stanley Terrace, Union, New Jersey 07083 and is identified as its "AA Series Weatherproof Photocontrol".

In FIG. 6 there is shown a solid state embodiment of the photoelectric controlled switch 46. As can be seen, the photoelectric controlled switch 46 of FIG. 6 comprises a photocell 48 connected in series with a resistor 54. A capacitor 56 is connected across the photocell. The common junction of resistor 54, a capacitor 56 and photocell 48 is connected to the gate electrode 58 of a triac 60. One side of the triac 60 is connected to the common junction of resistor 54 and the potentiometer 42. The other side of the triac 60 is connected to the common junction of capacitor 56 and photocell 48.

As will be appreciated by those skilled in the art, the solid state embodiment of the photoelectric control 46 shown in FIG. 6 operates in an electrically analogous manner to the mechanical embodiment described with reference to FIG. 5. To that end, when the ambient light sensed by photocell 48 drops below a predetermined value the triac 60 is gated into conduction, thereby enabling current to flow from the 120V, 60HZ source through the potentiometer 42 to the lamp 44 to effect the illumination thereof at the intensity established by the setting of potentiometer 42.

In accordance with a preferred aspect of this invention device 20 includes means for disabling the photocontrolled switching means 46 to permit manual adjustment of the intensity of the light produced by the lamp 44. To that end, a knob 62 is mounted on the shaft 49 of the potentiometer 42 and overlies the photocell 48 (FIG. 2).

Figure 3:
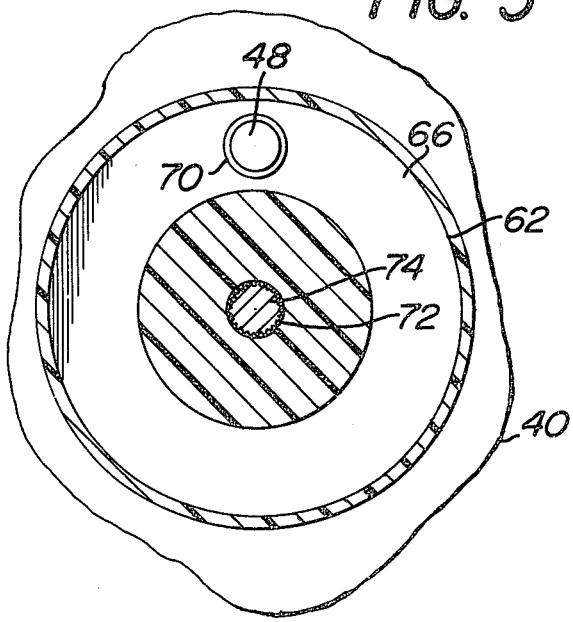
FIG. 3 is a sectional view taken along line 3—3 of FIG. 2.
Figure 2:
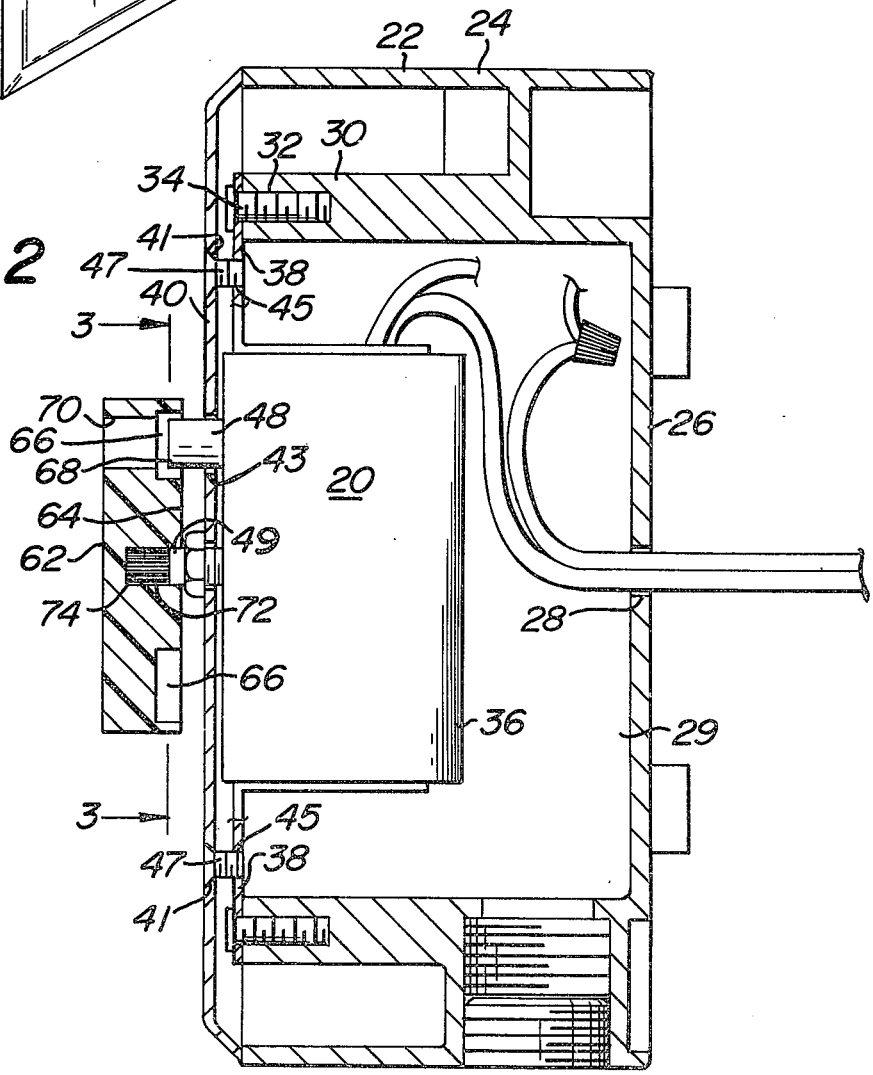
FIG. 2 is an enlarged sectional view taken along line 2—2 of FIG. 1.
Figure 4:
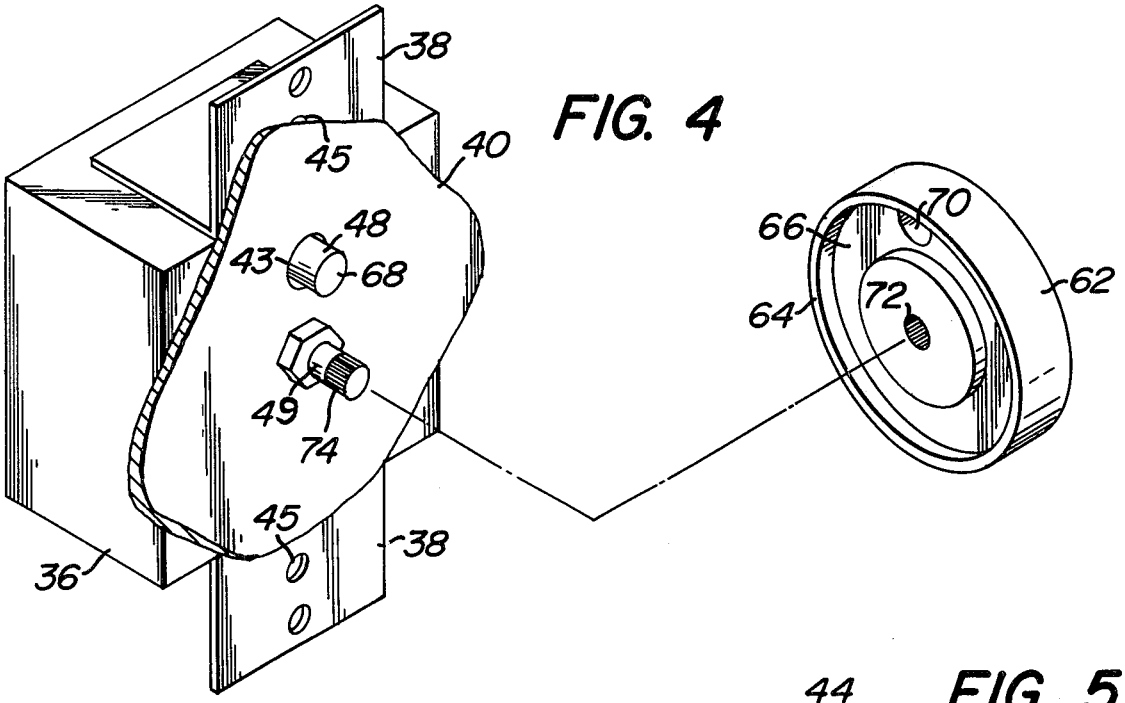
FIG. 4 is an exploded view of a portion of the device shown in FIG. 1.

As can be seen in FIGS. 2, 3 and 4, the underside 64 of knob 62 includes an annular recess 66 into which the light receiving face 68 of photocell 48 extends. By having the photocell face 68 disposed under knob 62 and within its recess 66 amibient light is precluded from impinging on the photocell face from the front or laterally.

The knob 62 includes an opening 70 which is arranged to overlie the photocell 48 to enable ambient light to reach the photocell face when the device 20 is utilized for automatic control of the lamp 44. To that end, opening 70 is disposed at the same radial distance from shaft 49 as is the photocell 48.

As will be appreciated by those skilled in the art, when the knob 62 is rotated to the position wherein the opening 70 overlies the photocell 48 ambient light is permitted to reach the photocell. As long as the ambient light intensity is above the threshhold level the photocell conducts and the photoelectric controlled switching means 46 is open to prevent current from flowing through the potentiometer 42 to lamp 44. However, when the ambient light intensity drops below the threshhold level the photocell ceases conducting, whereupon the photoelectric controlled switching means 46 closes and current is enabled to flow to the lamp to effect its illumination, with the magnitude of current flowing to the lamp being established by the setting of potentiometer 42. Since knob 62 is connected to the potentiometer 42, via its shaft 49, the lamp 44 is illuminated at an intensity level as established by the potentiometer setting, i.e., that setting at which the knob's opening 70 overlies the photocell 48.

Accordingly, when the device 20 is set up such that the photocell is exposed to the ambient light, via the opening 70 in knob 62, the device operates as an automatic control preventing illumination of the lamp when the ambient light is above the threshhold level, while enabling the lamp to illuminate at a predetermined intensity when the ambient light is below said level.

In accordance with a preferred embodiment of this invention the knob 62 is arranged to be mounted on the shaft 49 of the potentiometer 42 at any relative rotational position thereto to enable the knob to be positioned with its opening 70 overlying the photocell at any predetermined setting of the potentiometer 42, e.g., full-on (minimum resistance), half-on (middle resistance), etc. This feature enables the device 20, when operating automatically, to illuminate the lamp 44 at any predetermined intensity between "full-on" and "full-off" when the ambient light drops below the threshhold level of the device 20. To that end, the knob includes a splined central bore 72 adapted to receive and mount the splined free end 74 of the potentiometer shaft at any relative rotational position.

If one desires to set up the device 20 to illuminate the lamp 44 at maximum intensity when the ambient light drops below the threshhold level, the knob 62 is rotated so that the potentiometer is at its minimum resistance position. The knob 62 is removed from the shaft and then replaced on the shaft without disturbing the positioning of the shaft but this time with the opening of the knob overlying the photocell 48. Accordingly, any time that knob 62 is in the position wherein its opening 70 overlies the photocell, the potentiometer 42 will be at its minimum resistance value, such that when the ambient light drops below the threshhold level the lamp 44 will be illuminated at its maximum intensity. Needless to say, to set the device 20 up for any other lamp illumination intensity only involves the removal and repositioning of the knob 62 relative to the potentiometer shaft 49.

It should be appreciated by those skilled in the art, that irrespective of the relative position between the knob 62 and the potentiometer shaft 49, when the knob is rotated to any position other than the position in which opening 70 overlies the photocell, the device 20 is disabled from automatically affecting the lamp by virtue of the fact that the portion of the knob overlying the photocell prevents ambient light from reaching the photocell. Accordingly, in such cases the photoelectric switching means 46 is closed and the lamp is illuminated at the intensity setting established by the setting of the potentiometer 42.

Potentiometer 42 is, in accordance with a preferred aspect of this invention, of the conventional type found in lamp dimmers and includes an on-off switching means, whereupon depression of its shaft 49 turns the potentiometer on and off. By utilizing such a potentiometer the device 20 is capable of being turned on or off manually without necessitating any rotation of knob 62 and the concomitant variation of current through the potentiometer.

It should thus be appreciated from the foregoing that the device 20 of the instant invention is simple in construction yet enables the manual or automatic control of the intensity of illumination of a lamp connected thereto and with the intensity of such illumination being adjustable irrespective of whether the device is operated manually or automatically.

Without further elaboration, the foregoing will so fully illustrate my invention that others may, by applying current or future knowledge, readily adapt the same for use under various conditions of service.

What is claimed as the invention is:

1. A lamp dimmer with automatic photoelectric control for establishing the light output of an electric lamp comprising current adjusting means for adjusting the magnitude of electric current provided to said lamp to adjust its light output, said current adjusting means being coupled to a manually movable member, the position of said member establishing the magnitude of current conduction, and photoelectric controlled switching means being enabled to sense the intensity of ambient light when said movable member is in a first predetermined position, said photoelectric controlled switching means operating in response to the intensity of light reaching it to allow current of a predetermined magnitude to flow to said lamp to effect the illumination thereof when the intensity of the light reaching it is below a predetermined value.

2. The device of claim 1 wherein the magnitude of current enabled to flow to the lamp when the photoelectric controlled switching means senses that the intensity of the light reaching it is below said predetermined value is the magnitude as established by the position of the movable member of the current adjusting means.

3. The device of claim 2 wherein said photoelectric controlled switching means comprises a photocell and switching means response thereto, said photocell being mounted for exposure to ambient light, said photocell being covered by said movable member and thereby isolated from the ambient light at all positions of the movable member except the first predetermined position.

4. The device of claim 3 wherein the switching means responsive to the photocell comprises a solid state switching circuit.

5. The device of claim 3 wherein the switching means responsive to the photocell comprises a mechanical contact.

6. The device of claim 4 wherein said movable member comprises a rotary knob having an opening therein which overlies the photocell when the movable member is in said first predetermined position.

7. The device of claim 6 wherein the current adjusting means comprises a variable resistance device whose actuating member comprises a rotatable shaft and wherein said rotary knob is connected to said shaft.

8. The device of claim 6 wherein said knob is arranged to be relocated on said shaft in various orientations relative thereto so that when the knob is moved to said first predetermined position the intensity of light produced by the lamp under the control of the photoelectric switching means is adjustable.

9. The device of claim 3 wherein said movable member comprises a rotary knob having an opening therein which overlies the photocell when the movable member is in said first predetermine position.

10. The device of claim 9 wherein the current adjusting means comprises a variable resistance device whose actuating member comprises a rotatable shaft and wherein said rotary knob is connected to said shaft.

11. The device of claim 10 wherein said knob is arranged to be relocated on said shaft and various orientations relative thereto so that when the knob is moved to said first position the intensity of light produced by said lamp under the control of the photoelectric switching means is adjustable.

12. The device of claim 8 additionally comprising means for switching said device on and off when said knob is pushed in.

13. The device of claim 11 additionally comprising means for switching said device on and off when said knob is pushed in.

14. The device of claim 12 including means for mounting it within a conventional electrical junction box.

15. The device of claim 13 including means for mounting it with a conventional electrical junction box.

* * * * *